US006257163B1

(12) United States Patent
Carpenter

(10) Patent No.: US 6,257,163 B1
(45) Date of Patent: Jul. 10, 2001

(54) UTILITY TETHER AND APPARATUS THEREFORE

(76) Inventor: Kenneth Scott Carpenter, 7306 Gillon Dr., Rowlett, TX (US) 75089

( * ) Notice: Subject to any disclaimer, the term of this patent is extended or adjusted under 35 U.S.C. 154(b) by 0 days.

(21) Appl. No.: 09/417,454

(22) Filed: Oct. 13, 1999

(51) Int. Cl.[7] ..... B63B 21/04

(52) U.S. Cl. ..... 114/253; 24/115 F; 24/129 R

(58) Field of Search ..... 114/362, 253; 441/69, 75, 80, 84; 24/115 F, 129 R, 129 D, 132 R; 104/193, 201

(56) References Cited

U.S. PATENT DOCUMENTS

| | | | | |
|---|---|---|---|---|
| 292,281 | * | 1/1884 | Brewster | 441/84 |
| 295,194 | * | 3/1884 | Pitney | 403/211 |
| 411,161 | * | 9/1889 | Matnard | 441/84 |
| 602,569 | * | 4/1898 | Turner | 267/74 |
| 630,837 | * | 8/1899 | Anderson et al. | 24/129 R |
| 666,400 | * | 1/1901 | Tregoning | 24/129 R |
| 679,930 | * | 8/1901 | Webster | 24/130 |
| 917,738 | * | 4/1909 | Opsal | 294/74 |
| 1,745,702 | * | 2/1930 | Molitor | 280/493 |
| 2,303,954 | * | 12/1942 | Roke | 182/3 |
| 2,651,789 | * | 9/1953 | Newland | 114/362 |
| 2,878,013 | * | 3/1959 | Piodi | 267/69 |
| 2,944,506 | * | 7/1960 | Bartkowiak | 114/247 |
| 2,961,671 | * | 11/1960 | Meighan | 441/54 |
| 3,001,371 | | 9/1961 | Gilmore, Jr. et al. | 61/48 |
| 3,083,992 | * | 4/1963 | Post | 403/164 |
| 3,160,979 | * | 12/1964 | Bissell | 43/44.85 |
| 3,171,183 | * | 3/1965 | Johnston | 24/635 |
| 3,216,030 | * | 11/1965 | Garfield | 441/84 |
| 3,344,487 | * | 10/1967 | Doutt | 24/602 |
| 3,950,806 | | 4/1976 | Puchois | 9/8 R |
| 4,233,923 | * | 11/1980 | Casad et al. | 114/253 |
| 4,285,083 | * | 8/1981 | Wilson | 9/310 E |
| 4,378,750 | | 4/1983 | Holzhauer | 114/249 |
| 4,519,643 | * | 5/1985 | Harris | 294/19.1 |
| 4,523,913 | * | 6/1985 | Kaino | 441/81 |
| 4,596,530 | | 6/1986 | McGlinn | 441/80 |
| 4,661,077 | * | 4/1987 | Griffith et al. | 441/84 |
| 4,721,487 | | 1/1988 | Cochran | 441/80 |
| 4,861,301 | * | 8/1989 | Pomeroy et al. | 441/131 |
| 4,863,407 | | 9/1989 | Casad | 441/69 |
| 4,883,301 | | 11/1989 | Pugh | 294/77 |
| 4,912,816 | * | 4/1990 | Brandt | 24/129 |
| 5,159,891 | | 11/1992 | Lohr et al. | 114/230 |
| 5,163,694 | * | 11/1992 | Reichek | 280/47.26 |
| 5,183,220 | | 2/1993 | Cencula | 242/85.1 |
| 5,234,144 | * | 8/1993 | Iler | 224/191 |
| 5,330,378 | | 7/1994 | Park | 441/133 |
| 5,341,758 | | 8/1994 | Strickland | 114/253 |
| 5,468,167 | | 11/1995 | Givens | 441/40 |
| 5,476,404 | | 12/1995 | Price | 446/221 |
| 5,600,873 | * | 2/1997 | May | 24/3.2 |
| 5,689,860 | * | 11/1997 | Matoba et al. | 24/115 F |
| 5,873,758 | | 2/1999 | Mullins | 441/69 |
| 5,899,782 | * | 5/1999 | Martin | 441/66 |
| 5,987,707 | * | 11/1999 | DeShon | 24/17 AP |
| 6,014,833 | * | 1/2000 | Benavidez | 43/54.1 |
| 6,094,783 | * | 8/2000 | Parsons | 24/130 |

FOREIGN PATENT DOCUMENTS

| | | | | |
|---|---|---|---|---|
| 1214061 | * | 4/1966 | (DE) | 24/129 A |

* cited by examiner

*Primary Examiner*—S Joseph Morano
*Assistant Examiner*—Ajay Vasudeva
(74) *Attorney, Agent, or Firm*—Baker Botts L.L.P.

(57) ABSTRACT

A tether apparatus (100) has a tether (101), loops (104*a–f*) formed from the tether (101), and clamps (106*a–f*) maintaining the loops (104*a–f*). The clamps (106*a–f*) are operable to fail upon application of a predetermined amount of tension in the tether (101). The loops (104*a–f*) may be placed in alternating orientations along the longitudinal axis of the tether (101). The tether (101) may comprise a strap (118) operable to couple flotation devices (116) to the loops (104*a–f*).

34 Claims, 2 Drawing Sheets

UTILITY TETHER AND APPARATUS THEREFORE

TECHNICAL FIELD OF THE INVENTION

This invention relates generally to the field of aquatic devices and, more specifically, to utility tethers.

BACKGROUND OF THE INVENTION

A rising interest in aquatic recreation has led to the increasing demand for devices that enhance the enjoyment of water-related activities. Many people enjoy relaxing and socializing in the water, perhaps lounging on an inflatable raft and drinking a cold beverage from a cooler. A problem with this activity, however, is that inflatable rafts, coolers, and even people tend to float away with the moving water.

People and items may be coupled to a utility tether to prevent them from floating away. For example, a utility tether for use in connection with a life raft is shown in U.S. Pat. No. 5,468,167.

SUMMARY OF THE INVENTION

Known utility tethers are not completely satisfactory with respect to safety and simplicity. For instance, known utility tethers may have multiple loops spaced along a main tether. The loops are designed to withstand relatively high stress. The loops may be used to secure people to a utility tether attached to a life raft during, for example, conditions of high winds or rough water. Thus, the loops are fixed and designed to be permanent and able to withstand high stresses so that people are fixedly secured to the tether. This type of utility tether, however, is subject to potential misuse. Water skiers may attempt to use this type of utility tether as a ski rope. Towing multiple skiers in a row, one after another, creates a dangerous situation. If one skier falls, a skier behind him could seriously injure him with a ski.

Also, known tethers, while having spaced-apart loops, are not concerned with the orientation of the loops about the main tether. Typically, the loops are all oriented the same with respect to the main tether. That is, while the tether is in a non-twisted, rest state, the loops are all oriented at roughly the same angular relationship to an arbitrary axis of a cross section of the main tether. When such a utility tether is in the water, this orientation tends to result in people or items attached to the tether being positioned on the same side of the main tether relative to a longitudinal axis of the tether. This can ultimately result in undesirable clutter of people and objects or, alternatively, a need to space the loops further apart along the main tether.

Another disadvantage of known tethers is that the loops typically comprise separate pieces of material that must be attached to the main tether. For example, U.S. Pat. No. 5,468,167 shows loops that are separate pieces of material attached to the main tether via a knot. This configuration adds complexity to the utility tether. This also adds time, complexity, and expense to the tether assembly process. Moreover, because known utility tethers comprise many parts, each part must be individually manufactured and assembled. Having more parts generally translates to an increased cost of manufacturing. Utility tethers with a simpler design may be less costly to manufacture.

Due to these and other deficiencies in known utility tethers, together with an increase in the demand for better utility tethers with respect to safety and simplicity, a need has arisen for an improved utility tether. In accordance with the present invention, a utility tether apparatus is provided that addresses the disadvantages and problems associated with previously developed tether systems and methods.

Among other things, the present invention provides a tether having one or more links. In one embodiment, a plurality of links are provided. At least one link extends from the tether in a first direction. At least one link extends from the tether in a second direction. The first and second directions are angularly spaced apart with respect to a cross section of the tether.

According to various aspects of the invention, the links may be loops formed from the tether. The links may extend from alternating sides of the tether.

According to another embodiment, a tether has one or more loops formed from the tether and one or more clamps to maintain to loops. The clamps may be operable to fail upon application of a predetermined amount of tension to the tether. The loops may be formed by holding two spaced-apart points of the tether in close proximity.

In another embodiment, a clamp is provided for forming a loop from a tether. The clamp has a tubular body, which includes a first tubular portion and a second tubular portion extending from a side of the first tubular portion. The second tubular portion comprises a loop outlet and the loop protrudes from the loop outlet.

According to various aspects, the clamp may include a first body portion hingedly connected to a second body portion. The first and second body portions may be hingedly moved, relatively, from an open position to a closed position. In the closed position, the first and second body portion form the first and second tubular portions. A locking mechanism may be provided to secure the first and second body portions in the closed position. One or more protrusions may extend from the interior surface of the tubular body. The protrusions are operable to engage a portion of the tether disposed within the tubular body.

A technical advantage of the present invention is that the links are operable to fail under a predetermined amount of tension, thus preventing misuse of the invention. For example, the tether preferably cannot be used for towing water skiers, because the links will fail under the tension associated with towing water skiers. As a result, serious injury from towing multiple skiers is avoided.

Another technical advantage of the invention is its simplicity. The links of the tether are constructed from the main tether line itself, eliminating the need for constructing separate loops and coupling the loops to the tether, which often requires yet another component to make this connection.

Another technical advantage of the present invention is that the links may be placed in alternating orientations along the longitudinal axis of the tether. This avoids bunching of connected people or objects on one side of the tether or the other when the tether is resting in the water. This allows for a comfortable distance between users and objects connected to the main tether line.

Another technical advantage of the present invention is that floatation devices may be easily coupled and uncoupled from the tether.

Other technical advantages will be apparent to one of ordinary skill in the art from the following figures, descriptions, and claims.

BRIEF DESCRIPTION OF THE DRAWINGS

For a more complete understanding of the present invention and for further features and advantages, reference is now made to the following description, taken in conjunction with the accompanying drawings, in which.

DETAILED DESCRIPTION OF THE PREFERRED EMBODIMENTS

Figure 1:
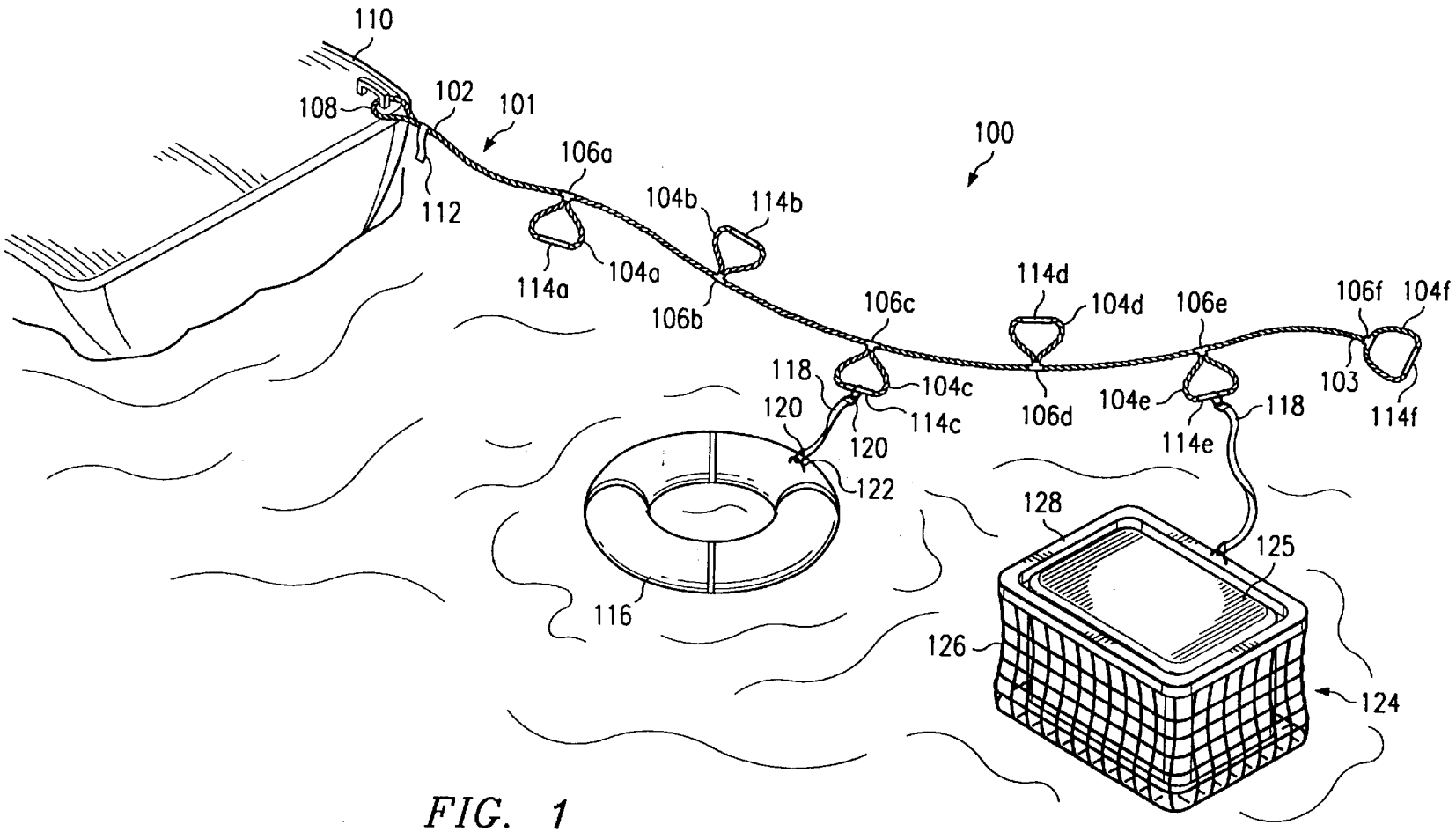
FIG. 1 illustrates one embodiment of an apparatus that may be used in accordance with the present invention.
Figure 2:
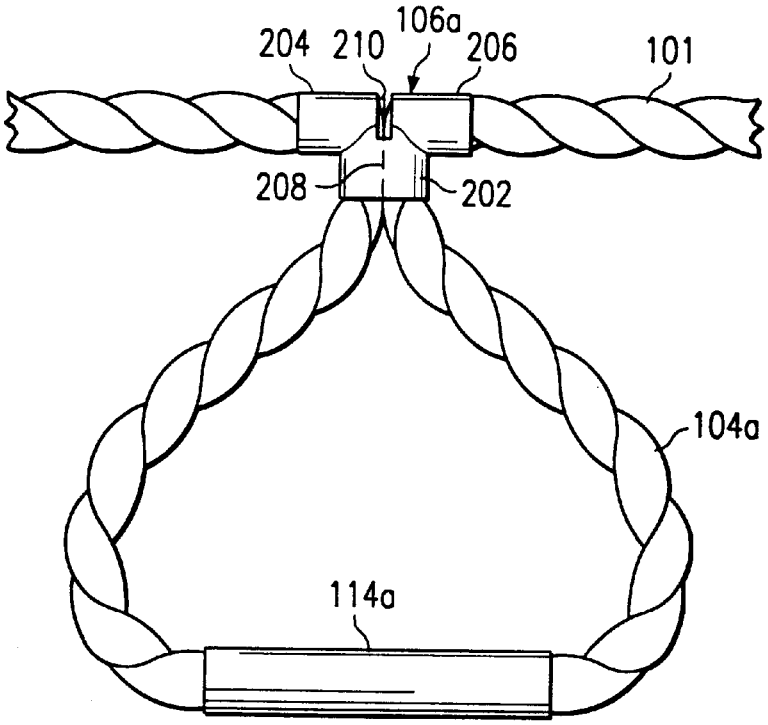
FIG. 2 illustrates one embodiment of a clamp and a loop that may be used in accordance with the present invention.
Figure 3:
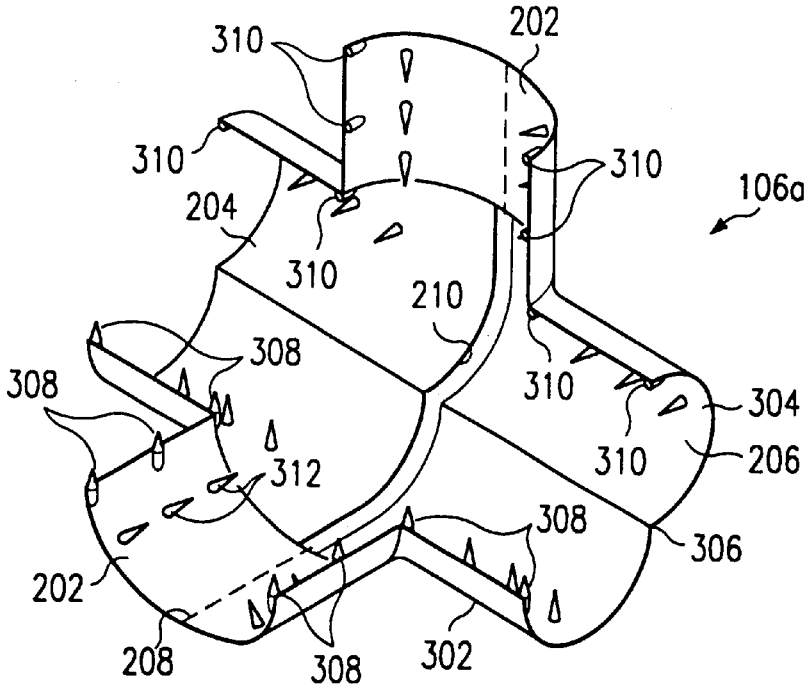
FIG. 3 illustrates, in greater detail, one embodiment of a clamp that may be used in accordance with the present invention.

An embodiment of the present invention and its advantages is best understood by referring to FIGS. 1 through 3 of the drawings, like numerals being used for like and corresponding parts of the various drawings.

FIG. 1 illustrates one embodiment of an apparatus 100 that may be used in accordance with the present invention. A utility tether apparatus 100 comprises a tether 101 having a first end 102 and a second end 103. Apparatus 100 also has links 104*a–f* formed from tether 101, and clamps 106*a–f* forming links 104*a–f* from the tether 101.

In this embodiment, links 104*a–f* are formed as loops formed from tether 101. However, according to various aspects of the present invention, the links may comprise other types of connection points, handles, latches, and so forth that can be formed from the tether 101, or formed separately from tether 101 and attached by any suitable connection device. In connection with this embodiment, links and loops may be used interchangeably; however, the invention is not so limited.

Tether 101 may comprise, for example, a rope comprising any suitable rope material such as, for example, man-made or natural fibers, plastic or fabric, and may comprise a floatable rope. Preferably, tether 101 is approximately thirty feet long after the links have been formed. However, any other length may be used and still incorporate aspects of the present invention. Tether 101 may comprise a coupling device 108, for example, a loop or a hook, at first end 102 operable to couple tether 101 to, for example, a boat 110 or a dock (not shown). First end 102 of tether 101 may also comprise a strap 112 that may be removably coupled, for example, a VELCRO strap, to secure tether 101 for storage and prevent it from becoming tangled. Links 104*a–f* preferably comprise loops formed from approximately one to two feet of tether 101. However, loops of other sizes may be used. The links 104*a–f* are preferably spaced, for example, approximately three to four feet apart along tether 101, and may be alternating in direction to create a comfortable distance from between people or objects connected to apparatus 100. A handle 114*a–f* may be coupled to one or more of the links 104*a–f*. The handle 114*a* may comprise, for example, a rubber tube encasing tether 101. A link 104*f* may be located at second end 103 of the tether 101.

According to one aspect of this embodiment, and as discussed above, the links 104*a–f* may be oriented so as to extend from the tether 101 in different directions with respect to a cross-section of the main tether 101. Preferably, this is accomplished by forming loops from the tether and taking advantage of the natural tendency of the tether material to avoid twisting. Thus, when a loop is formed, the loop tends to maintain its angular orientation with respect to the main tether. For example, if the water is considered to be a plane, loops may be formed from the tether material to extend along the plane of the water to one side or the other of the main tether. The natural tendency of the tether material to avoid twisting causes the loops to tend to remain in a configuration where they extend from alternating sides of the main tether. Even if some twisting occurs, there will be at least some loops on one side of the main tether and some on the other. Also, tether 101 may be formed from floatable rope material so that the loops tend to float on the surface of the water, thereby further forcing the loops and tether to remain in a steady configuration and avoid twisting. Furthermore, the material for handles 114*a–f* may comprise a floatable material to provide similar benefits.

According to another aspect of the invention, various devices may be attached to the tether 101. A flotation device 116, for example, a life preserver, an inflatable raft, or a foam lounger, may be coupled to a loop 104*c*, using a strap 118, which may be, for example, approximately two to three inches long. The strap 118 may comprise connectors 120 on the ends thereof. The connector may comprise, for example, plastic D-hooks or plastic slide-hooks on each end operable to couple the flotation device 116 to the tether 101. The floatation device 116 may comprise a hoop 122 to which one of the connectors 120 may be coupled. Another flotation device may comprise, for example, a cooler flotation stabilizer 124 operable to stabilize a cooler 125. The cooler flotation stabilizer 124 may comprise a mesh material 126 operable to hold a cooler 125, and may also comprise floating material 128 operable to keep the cooler 125 afloat. The straps may be connected to the main body of the tether 101 or, alternatively, to one of the links 104*a–f*.

As shown in FIG. 2, another embodiment of the present invention includes a clamp for assisting in the creation of loops 104*a–f*. FIG. 2 illustrates one embodiment of a clamp 106*a* and a loop 104*a* that may be used in accordance with the present invention. The clamp 106*a* is used to form a loop 104*a* from the tether 101. A loop 104*a* has a first end corresponding to a first point on the tether and a second end corresponding to a second point on the tether, and a clamp 106*a* is operable to hold the first and second ends in close proximity. The clamp 106*a* may comprise a first tubular portion 201 and a second tubular portion 203 extending outward from a side of the first tubular portion 201. The second tubular portion 203 comprises a loop outlet 202. In this embodiment, the clamp 106*a* comprises a T-joint, which may have a loop outlet 202, a first tether outlet 204, a second tether outlet 206, and a stress line 208. The clamp 106*a* may form a loop 104*a* by clamping together two spaced apart points spaced apart of the tether 101, such that the loop 104*a* extends from the loop outlet 202. The remaining portions of the main body of tether 101 extend from the first tether outlet 204 and the second tether outlet 206. The stress line 208 is operable to fail upon application of a predetermined amount of tension in the tether, for example, the amount approximately equal to the tension applied when the tether is being used to pull a waterskier weighing more than thirty pounds at a speed greater than one mile per hour. Other amounts may be used, for example, the amount approximately equal to pull a water skier weighing more than sixty pounds at a speed greater than three miles per hour. The stress line may have, for example, perforations or a gap 210 that causes the clamp to fail. The loop 104*a* may also comprise a handle 114*a*. The handle 114*a* may comprise, for example, a rubber tube encasing the tether 101. Preferably, the handle material will float in water.

FIG. 3 illustrates, in greater detail, one embodiment of a clamp that may be used in accordance with the present invention. In this embodiment, the clamp 106*a* comprises a T-joint, which may have a loop outlet 202, a first tether outlet 204, a second tether outlet 206, and a stress line 208. The clamp 106*a* may also comprise a first body portion 302, and second body portion 304, and a hinge 306, which is operable to hold the first and second body portions 302 and 304 together. The hinge 306 may be located along an axis parallel to the longitudinal axis of the first tubular portion 201. To form the loop 104*a,* the tether 101 may be placed in the first body portion 302 such that the loop 104*a* extends from the loop outlet 202 and the remaining parts of the tether extend from first and second tether outlets 204 and 206, respectively. The second body portion 304 may be clamped to the first body portion 302. The first body portion 302 and the second body 304 may be hingedly closed to a closed position from an open position to form the first and second tubular portions 201 and 203.

Preferably, the first and second body portions 302 and 304 are secured to each other by a locking mechanism that includes male prongs 308 which fit into female receptacles 310. However, other connection devices may be used. Preferably, each female receptacle 310 comprises a cavity with an annular ridge (not expressly shown). The male prongs each preferably comprise a head that is tapered from a leading end, which is smaller than the opening formed by the annular ridge, to a trailing end, which is slightly larger than the opening created by the annular ridge. The trailing end preferably comprises a locking surface so that when the prong is inserted into the receptacle, and the trailing edge is forced past the annular ridge, the locking surface will engage the annular ridge to prevent the prong from leaving the receptacle. In this manner, the prongs are snap-locked into the receptacles.

Protrusions, for example, spikes 312 may be used to secure the tether 101 inside of the clamp 106*a*. The spikes 312 preferably engage the tether material and prevent the tether material from slipping back and forth within the claim when the clamp is closed, thus maintaining the size of the loop. The stress line 208 is operable to fail upon application of a predetermined amount of tension in the tether, for example, the amount approximately equal to the tension applied when the tether is being used to pull a waterskier weighing more than thirty pounds at a speed greater than one mile per hour. Other amounts may be used, for example, the amount approximately equal to pull a water skier weighing more than sixty pounds at a speed greater than three miles per hour. The stress line 208 may have, for example, perforations or a gap 210 that causes the clamp to fail. The perforations or gap 210 may reduce the amount of tension in the tether needed for the clamp 106*a* to fail, such that less tension in the tether is needed for a clamp with perforations or a gap to fail than that needed for a clamp without perforations or a gap 210.

A technical advantage of the present invention is that the clamps are operable to break under a predetermined amount of stress, thus preventing misuse of the invention. For example, the predetermined amount of stress can be designed to be an amount typically associated with pulling a water skier. Thus, the tether would not be capable of use for towing water skiers, because the loops would break under the predetermined amount of stress. As a result, serious injury from towing multiple skiers is avoided. Another technical advantage of the invention is its simplicity. The loops of the tether are constructed from the tether itself, eliminating the need for constructing separate loops and devices for coupling the loops to the tether. Another technical advantage of the present invention is that the loops are placed in alternating directions along the tether. Preferably, the loops extend away from the longitudinal axis of the main tether body in opposite directions. This allows for a comfortable distance between users. Another technical advantage of the present invention is that flotation devices may be easily coupled to and uncoupled from the tether.

Although embodiments of the invention and its advantages have been described in detail, a person skilled in the art could make various alternations, additions, and omissions without departing from the spirit and scope of the present invention as defined by the appended claims.

What is claimed is:

1. A tether apparatus, comprising:

a tether;

one or more loops formed from the tether, the one or more loops adapted to couple people to the tether;

and one or more clamps maintaining the one or more loops, the one or more clamps operable to fail upon application of a predetermined amount of tension in the tether.

2. The tether apparatus of claim 1, wherein the tether comprises a floatable rope.

3. The tether apparatus of claim 1, further comprising a coupling device disposed at a first end of the tether and a loop disposed at a second end of the tether.

4. A tether apparatus, comprising:

a tether;

one or more loops formed from the tether, the one or more loops adapted to couple people to the tether;

a handle coupled to at least one of the loops; and one or more clamps maintaining the one or more loops, the one or more clamps operable to fail upon application of a predetermined amount of tension in the tether.

5. The tether apparatus of claim 4, wherein the handle is a tube encasing a portion of the tether forming one of the loops.

6. The tether apparatus of claim 4, wherein the loops are spaced apart along a length of the tether and extend from the tether on alternating sides of the tether.

7. The tether apparatus of claim 4, wherein at least one loop is formed from approximately one to two feet of the tether.

8. The tether apparatus of claim 4, wherein at least one loop has a first end corresponding to a first point on the tether and a second end corresponding to a second point on a tether, and one of the clamps is operable to hold the first and second ends of the at least one loop in close proximity to form the at least one loop without the tether crossing itself.

9. The tether apparatus of claim 4, wherein at least one clamp has a first tubular portion and a second tubular portion, the second tubular portion having a first end coupled to a side of the first tubular portion, and a second end extending outward from a side of the first tubular portion, the interiors of the first and second tubular portions being in communication, the second end of the second tubular portion comprising a loop outlet, and one of the loops protruding from the loop outlet.

10. The tether apparatus of claim 4, wherein at least one clamp comprises a tubular T-joint having first and second tubular portions with first and second interiors, respectively, the first and second interiors being in communication.

11. The tether apparatus of claim 10, wherein the T-joint is operable to form a loop from the tether by clamping together two spaced-apart points of the tether.

12. The tether apparatus of claim 4, wherein at least one clamp is operable to maintain the size of the loops.

13. The tether apparatus of claim 4, wherein at least one clamp has one or more perforations, and the clamp is operable to fail at the perforations upon application of a predetermined amount of tension in the tether.

14. The tether apparatus of claim 4, wherein at least one clamp has a gap, and the clamp is operable to fail at the gap upon application of a predetermined amount of tension in the tether.

15. The tether apparatus of claim 4, further comprising a strap operable to couple a flotation device to one of the loops.

16. The tether apparatus of claim 4, further comprising at least one flotation device operable to be coupled and uncoupled from one of the loops, wherein the at least one flotation device has at least one hoop operable to couple the at least one floatation device to the loop.

17. The tether apparatus of claim 4, further comprising at least one flotation device operable to be coupled to and uncoupled from one of the loops, wherein the at least one flotation device comprises a cooler stabilizer.

18. A tether apparatus, comprising:

a tether having a plurality of links, at least one link extending outward from the tether in a first direction, and at least one link extending outward from the tether in a second direction, the first and second directions being angularly spaced a part with respect to a cross-section of the tether.

19. The tether of claim 18, wherein the link is oriented on one side of the tether and at least one link is oriented on the other side of the tether.

20. The tether apparatus of claim 18, wherein the links extend from the tether on alternating sides of the tether.

21. The tether of claim 18, wherein at least one of the links comprises a loop formed from the tether.

22. A clamp for forming a loop from a tether, comprising:

a tubular body, the tubular body comprising:

a first tubular portion; and a second tubular portion extending outward from a side of the first tubular portion, wherein the second tubular portion comprises a loop outlet, the interiors of the first and second tubular portion being in communication; and wherein the clamp is operable to fail upon application of a predetermined amount of tension in the tether.

23. The clamp of claim 22, wherein the clamp has one or more perforations operable to reduce the amount of tension in the tether under which the clamp is operable to fail.

24. The clamp of claim 22, wherein the clamp has a gap operable to reduce the amount of tension in the tether under which the clamp is operable to fail.

25. The clamp of claim 22, wherein the clamp has one or more perforations and is operable to fail at the perforations upon application of a predetermined amount of tension in the tether.

26. The clamp of claim 22, wherein the clamp has a gap and is operable to fail at the gap upon application of a predetermined amount of tension in the tether.

27. The clamp of claim 22, wherein the clamp is operable to fail upon the application of tension in the tether approximately equal to the tension applied when the tether is being used to pull a water-skier weighing more than thirty pounds at a speed greater than one mile per hour.

28. The clamp of claim 22, wherein the clamp is operable to fail upon the application of tension in the tether approximately equal to the tension applied when the tether is being used to pull a water skier weighing more than sixty pounds at a speed greater than three miles per hour.

29. The clamp of claim 22, further comprising one or more protrusions extending from an interior surface of the tubular body and operable to engage a portion of the tether disposed within the tubular body.

30. The clamp of claim 22, the tubular body having a first body portion and a second body portion hingedly coupled to the first body portion.

31. The clamp of claim 30, wherein the first and second body portions are hingedly coupled along an axis parallel to a longitudinal axis of the first tubular portion.

32. The clamp of claim 31, wherein the first and second body portions may be moved relatively from a first open position to a second closed position to form the first and second tubular portions.

33. The clamp of claim 30, wherein the first and second tubular portions are formed by hingedly closing the first and second body portions.

34. The clamp of claim 33, further comprising a locking mechanism to secure the first and second body portions in a closed position.

* * * * *